US006030284A

United States Patent [19]

Frank

[11] Patent Number: 6,030,284

[45] Date of Patent: Feb. 29, 2000

[54] COIN COUNTING AND SORTING MACHINE

[75] Inventor: Jerry Frank, Arlöv, Sweden

[73] Assignee: Scan Coin AB, Malmo, Sweden

[21] Appl. No.: 09/011,872

[22] PCT Filed: Aug. 21, 1996

[86] PCT No.: PCT/SE96/01030

§ 371 Date: Jun. 8, 1998

§ 102(e) Date: Jun. 8, 1998

[87] PCT Pub. No.: WO97/07485

PCT Pub. Date: Feb. 27, 1997

[30] Foreign Application Priority Data

Aug. 21, 1995 [SE] Sweden ..... 9502887

[51] Int. Cl.[7] ..... G07D 3/16

[52] U.S. Cl. ..... 453/3; 198/836.2; 453/56

[58] Field of Search ..... 453/3, 4, 7, 11, 453/56; 198/836.2

[56] References Cited

U.S. PATENT DOCUMENTS 5,114,381 5/1992 Ueda et al. ..... 453/57

5,163,868 11/1992 Adams et al. ..... 453/11

5,232,398 8/1993 Maki ..... 453/56 X 5,531,640 7/1996 Inoue ..... 453/56 X 5,551,911 9/1996 Rumbach ..... 453/3

*Primary Examiner*—F. J. Bartuska

*Attorney, Agent, or Firm*—James Ray & Associates

[57] ABSTRACT

A coin counting and sorting machine has a coin lifting device with an open bowl for receiving and forwarding an unsorted mass of coins, a sorting device for sorting coins being supplied thereto, and a coin transferring device for transferring the coins from the coin lifting device to the coin sorting device while establishing an order among the coins suitable for sorting and counting. The coin transferring device is provided with a first and a second element between which a transportation channel for the coins is disposed, wherein the first element is movable with respect to the second element so as to effect the transferring of the coins, and with a resilient device arranged with the transportation channel for pressing the coins against the first, movable element with a locally increased coin transferring speed as a result.

12 Claims, 5 Drawing Sheets

COIN COUNTING AND SORTING MACHINE

TECHNICAL FIELD

The present invention relates to a coin counting and sorting machine, comprising a coin lifting device for receiving and forwarding an unsorted mass of coins, a sorting device for sorting coins supplied thereto, and a coin transferring device for transferring the coins from the coin lifting device to the sorting device while establishing an order among the coins suitable for the sorting and counting process.

DESCRIPTION OF THE PRIOR ART

Various devices for sorting and/or counting coins are previously known. Main parts in one common type of such coin handling machines are: a coin lifting device for receiving a typically unsorted mass of coins, a sorting device, some kind of transferring device for transporting coins forwarded from the coin lifting device to the sorting device, and sensor means for counting the number of coins of each type.

SE-C-375 173 discloses a coin lifting device, comprising a coin bowl and a rotatable disc of elastic material arranged at an inclination therein, said disc contacting a concave support means, which is arranged to provide the disc with a steeper inclination at the upper part of its rotational path than at the lower portion thereof, and a separating knife arranged in contact with the disc surface at the upper portion thereof, said knife providing a roller way for coins lifted by the coin lifting device. The disc is provided with a plurality of radially oriented carrier rails protruding from the surface of the disc.

U.S. Pat. No. 5,163,868 discloses a coin sorting machine with a coin lifting device, where the latter comprises a plane and rotatable disc, which is arranged at a certain backward inclination in a coin bowl and is provided with a plurality of carriers along the disc circumference. When the disc is rotated, any coins present in the coin bowl are intercepted by the carriers and are thus carried along a substantially vertical and circular path. When a coin reaches the upper portion of the path, due to the gravity the coin will slide off the carrier and down to an inclined roller path, the coin thereafter being transported in a rolling motion to the next step of the coin handling process.

For instance through the Swedish patent application 9501357-9—which has not become public yet—it is known to use a roller path, i.e. an inclined path, which at its upper end is supplied with coins from for instance a coin lifting device according to the above, as a transferring device for the coins. Thanks to the inclination of the path the coins are forced to roll down the same and may hence be transported to a sorting device positioned at the end of the path. The risk of having a coin fall off the path during the transport is reduced, but not completely eliminated, by the fact that the path has been given a slight inclination backwards in the cross direction. An important function of the coin transferring device is to establish such an order among the coins, which is suitable for any subsequent sorting and/or counting process. A suitable order is fulfilled for instance when the coins are separated by a sufficiently—but not excessively—large distance between each other and when they are not positioned on top of each other. The path is required to have a rather considerable length, which obviously will limit the possibilities of implementing a compact machine, in order for the coins to be arranged in a suitable order during such a passive transport down a roller path. Another drawback with such a passive coin transferring device is the difficulties in transporting coins with a non-circular shape, such as a polygonal shape. The lack of active elements further reduces the possibilities of automatically relieving coin congestions, which otherwise will lead to an undesired interruption of the coin flow. To remedy such coin congestions there is consequently a need for a manual operation, e.g. uncovering the location of the congestion and then clearing the location by means of suitable tools.

In the Swedish patent application (9501357-9) mentioned above there is also shown a sorting device comprised in the coin handling machine, said sorting device comprising a circular path provided with coin falling openings of gradually increasing size and with a rotatable carrier, said carrier being adapted to carry incoming coins across the circularly arranged falling openings. Consequently, the sorting is carried out in a passive way: a coin which is carried across the falling openings will fall down through the first opening, which is sufficiently large. A considerable drawback with such passive sorting devices is that the sizes of the coin falling openings will be fixed to the sizes of the coins in a certain coin system. If any type of coin is added or removed, or if there is a desire to use the machine together with another coin system, substantial modifications must consequently be made to the machine.

The U.S. Pat. No. 5,114,381 discloses a coin feeding apparatus for a coin handling machine of the rotatable disc kind, including a guide extending along the coin flow path in the vicinity of an opening in a guide ring. The guide is swingable between a first position, where its face is smoothly aligned with the inner circumference of the guide ring, and a second position, where the face is not smoothly aligned. The guide means, when disposed in its second position, acts to prevent the jamming of coins, when the coins are driven in a reverse direction back through the opening onto the rotatable disc.

SUMMARY

According to the invention a coin counting and sorting machine has been developed, which uses an active coin transfer as well as an active sorting of the coins. In this way the machine may be given a more compact shape, and at the same time the machine will be very flexible when it comes to handling different types of coins. Thanks to the fact that the machine according to the invention provides a coin handling at a very high precision, i.e. a low error rate, a high sorting speed as well as a high automation level may be achieved.

The object of the invention is achieved by a coin counting and sorting machine with features according to the appended claim 1.

BRIEF DESCRIPTION OF THE DRAWINGS

The machine according to the invention will now be described in more detail, reference being made to the accompanying drawings, in which.

DETAILED DESCRIPTION OF EMBODIMENTS

Figure 1:
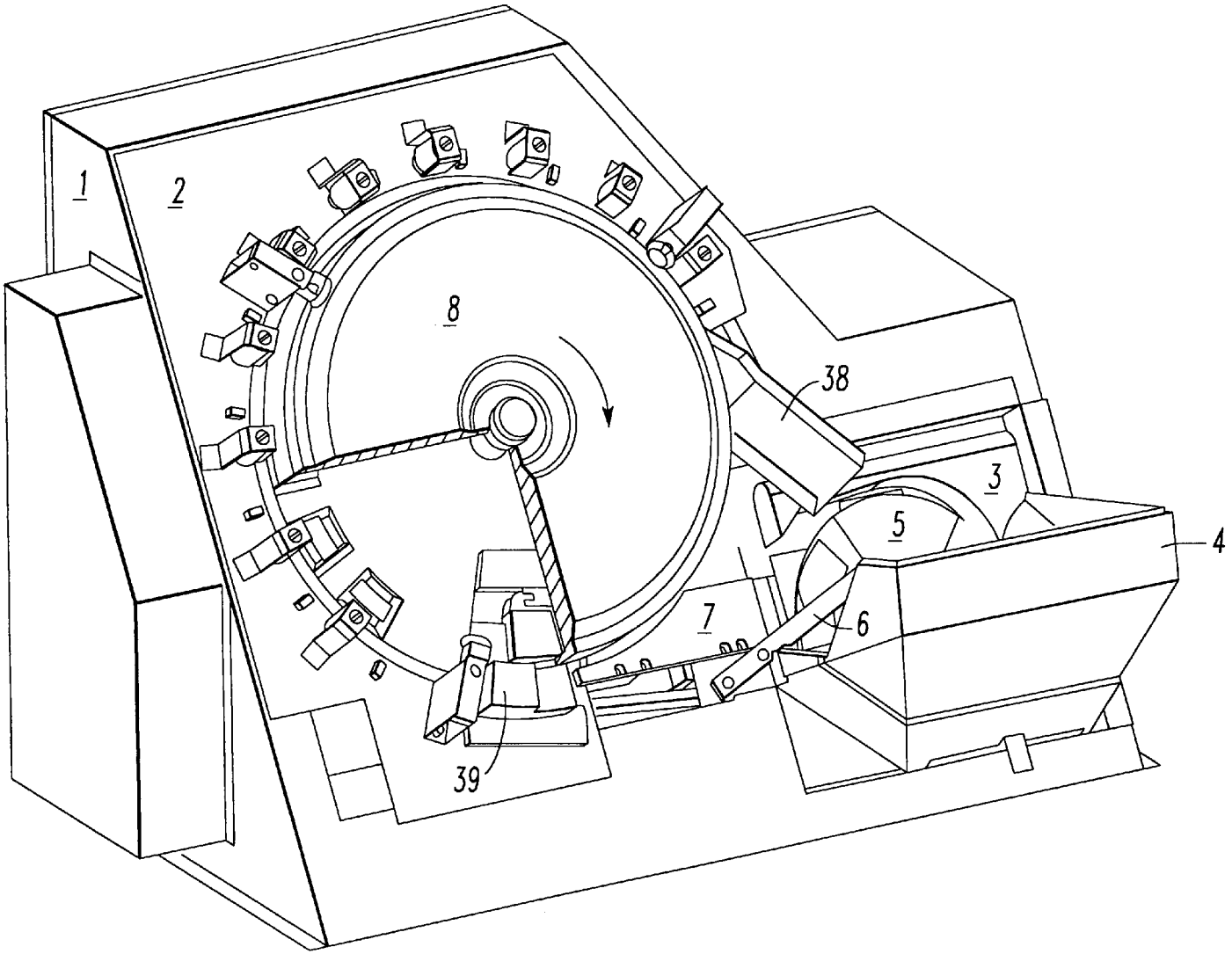
FIG. 1 is a fractional and perspective view of a preferred embodiment of the machine.

The design according to a preferred embodiment of the machine appears from FIG. 1, which illustrates the arrangement of the main portions of the machine. In addition to the parts shown in the figure the machine also comprises various external pieces of equipment, such as plates for cover and protection, mounting or suspension means, etc. Such external equipment is well-known within the technical field, and hence it is not further described here.

The main elements of the machine are arranged on a front portion 2 of the machine body portion 1, which may be manufactured in a known way and from known materials, such as metal or plastics.

A coin lifting device 3 is arranged on the front portion 2 in a plane, which slightly deviates from the vertical plane. The coin lifting device comprises a coin bowl 4, which is open at its upper portion, for depositing the mass of coins to be sorted. Furthermore, the coin lifting device comprises a rotatable and flexible lifting means 5, which is arranged inside the coin bowl, and a separating knife 6, which is arranged in contact with means 5. In essence, the coin lifting device is designed according to the description above in section Description of the prior art and in SE-C-375 173, and hence it is based upon known technology and is not described in more detail now.

The separating knife 6, one end of which according to the above is arranged in connection with the coin lifting device at a downward inclination with respect to the same, is connected at its second end to a coin transferring device 7. The coin transferring device will be further described below and is arranged to provide an active and controlled driving of a conveyor belt so as to transfer incoming coins to a sorting device 8, which will be described in more detail below, too.

Figure 2:
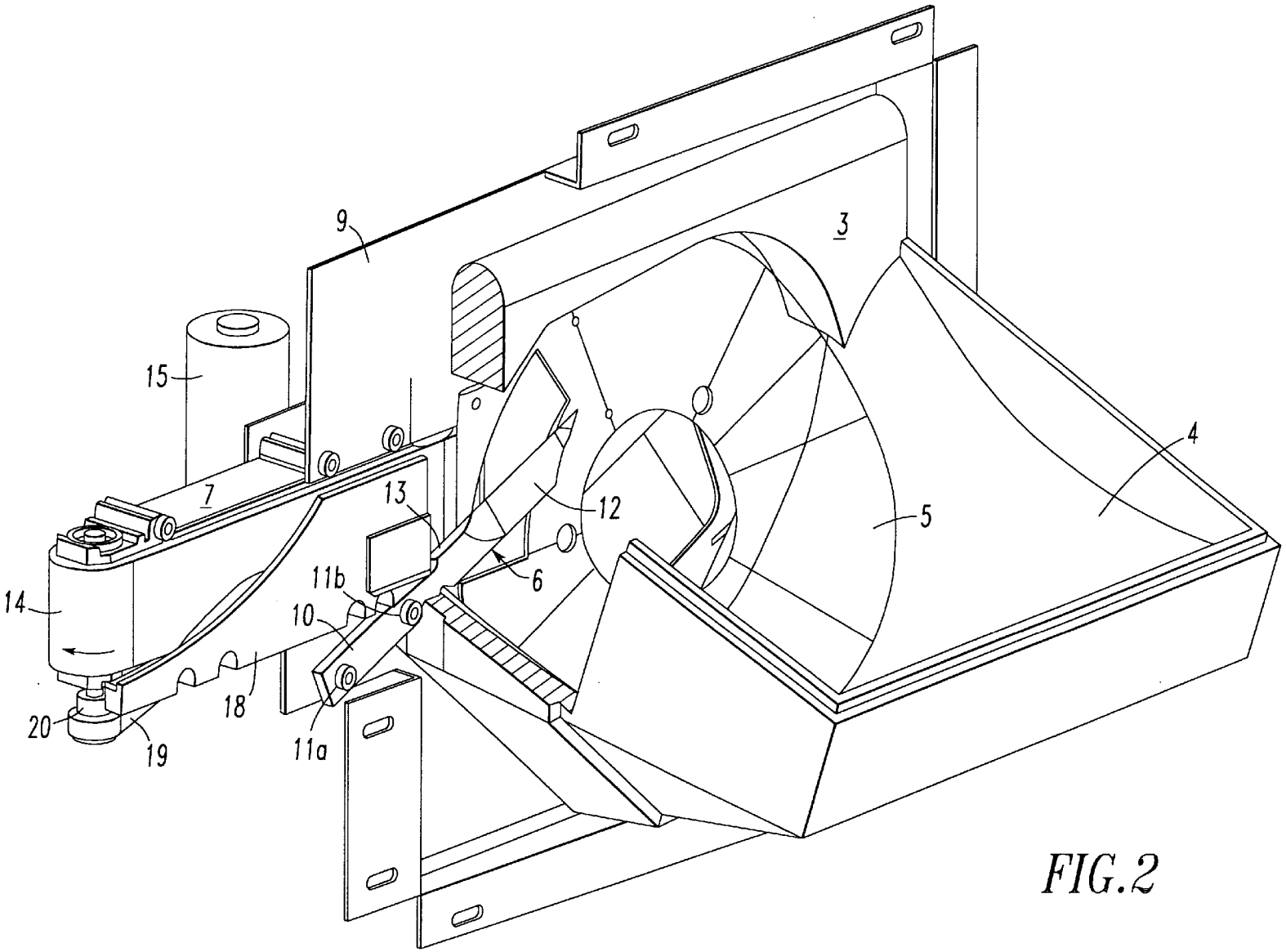
FIG. 2 is a fractional and perspective view of a coin transferring device comprised in the machine, said device connecting to a coin lifting device, which in essence is previously known.

In FIG. 2 the coin lifting device 3 mentioned above is shown to be arranged on a front plate 9 for mounting to the machine front portion 2. The separating knife 6 is mounted at its shaft portion 10 to the front plate 9 by means of two pins 11*a*, 11*b*, and according to the above the separating knife is arranged to separate coins being forwarded by the coin lifting device. In order to avoid to the largest possible extent that a plurality of coins are separated simultaneously and "abreast" each other, which would cause problems in the subsequent sorting process, the separating knife 6 is provided with a sharp edge 12. When two or more coins arrive together at the separating knife, the outer-most coin will be "pealed off" and fall back into the coin bowl to continue its tumbling journey therein. However, it may in practice not be possible to completely avoid more than one coin from being separated together. Thanks to the embodiment of the coin transferring device described below such a situation may, however, be remedied with ease.

By the inclination of the separating knife, coins which have been separated will be brought into a rolling downward motion along the short blade portion 13, the upper side of which has been made flat so as to avoid coins from falling off the knife once separated. The end of this short rolling portion is connected to the coin transferring device 7. This device is mounted to the front plate 9 and comprises a conveyor belt 14, a driving means 15, resilient means 16, 17, and a supporting means 18. By means of a driving belt 19 between the driving means and a first axle 20 of the conveyor belt the driving means 15 is arranged to drive the conveyor belt 14 in a direction from the separating knife 6 to the sorting device 8 shown in FIG. 1, i.e. the conveyor belt 14 is rotated from right to left in the figures. The normal rotational direction of the conveyor belt is indicated by the arrow in FIG. 2. The belt is made from a suitable material, such as rubber or any similar material, the frictional properties of which are strong enough to drive the coins forward according to what will be described below. Preferably, the driving means 15 is a conventional electric motor, such as a continuous-current motor.

Figure 3:
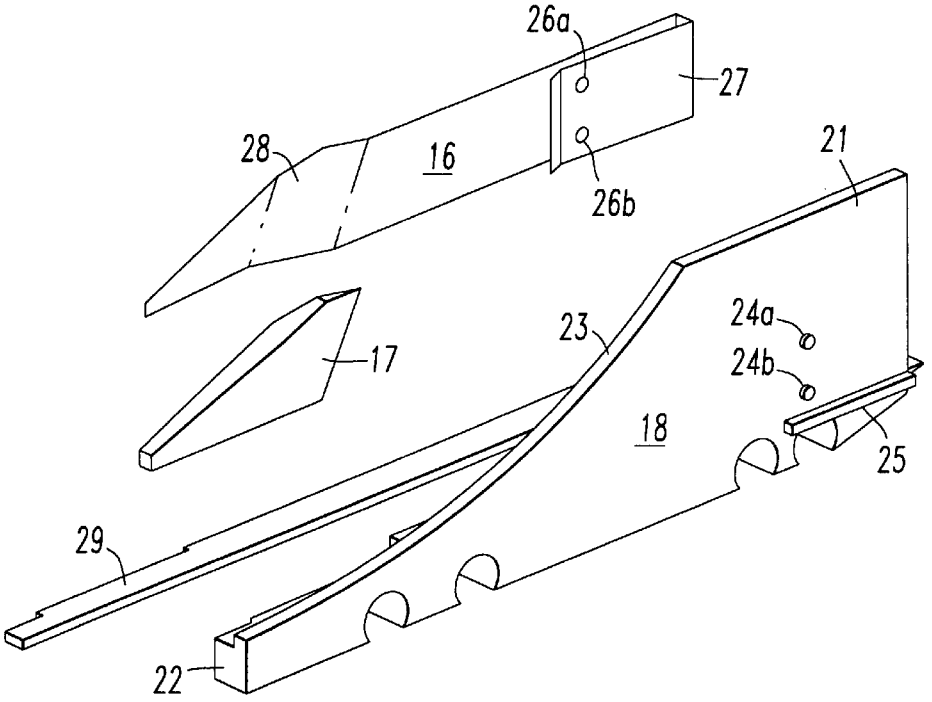
FIG. 3 is an exploded perspective view of certain parts comprised in the coin transferring device.

In FIG. 3 the supporting means 18 is shown together with the resilient means 16, 17 in the shape of a leaf spring 16 and a resilient foam-rubber element 17. The supporting means 18 is preferably made from metal or plastics and is provided with an upper vertical portion 21 and a lower horizontal portion 22, the latter of which is arranged at an angle with the upper portion and may be seen behind the same in FIG. 3. From the point of view according to the figure the upper portion 21 is provided at its leftmost end with a recess portion 23, which according to FIG. 1 aligns with a segment of the circumference of the sorting device 8 to facilitate the connection of the coin transferring device to the sorting device. Furthermore, two pins 24*a*, 24*b* and a support edge 25 are arranged on the rightmost end of the upper portion 21. Two holes 26*a*, 26*b* in the rightmost portion 27 of the leaf spring 16 correspond to said pins, and according to FIG. 3 the rightmost portion 27 is first bended once at a right angle and then once more at a right angle. Thanks to these bended portions as well as the holes 26*a*, 26*b*, the pins 24*a*, 24*b* and the support edge 25, the leaf spring 16 may be mounted around the rightmost end of the upper portion 21 of the supporting means 18. The leftmost end 28 of the leaf spring, i.e. the free end thereof, has a narrowing shape so as to fit with the circumference of the sorting device 8, and furthermore this end is provided with a particular bended shape so as to apply a force to the passing coins towards the conveyor belt as described below. The foam-rubber element 17 is positioned between the leaf spring 16 and the rear side of the upper portion 21 of the supporting means so as to enhance the spring force. The lower portion 22 is, at least partly, covered with a layer 29 of an anti-bounce material, as described below.

The driving means 15 is operatively connected to a controller for controlling the rotational speed of the conveyor belt and, hence, also the speed at which coins will be transported from the coin lifting device to the sorting device. Furthermore, the driving means is capable of driving the conveyor belt backwards, and this is particularly suitable when clearing coin congestions, which have interrupted or decreased the flow of coins.

The operation of the coin transferring device will now be described. The coin lifting device 3 described above receives and forwards the coins in a mass of coins, and then the coins are separated by the edge 12 on the separating knife 6. Usually the coins are separated one by one, as is desired, but according to the above two coins will sometimes be separated "abreast" and simultaneously. A separated coin will roll down the inclined knife to the beginning of the coin transferring device and into the space between the running conveyor belt 14 and the leaf spring 16. When the coin falls down on the lower horizontal portion 22 of the supporting means, there is a risk of bouncing effects, and hence the layer 29 of anti-bounce material is adapted to eliminate or at least reduce such effects.

Due to the design of the leaf spring according to FIG. 3 the force applied by the leaf spring onto the coin and towards the conveyor belt is small or even non-existent at the beginning of the transport path. The entire coin transferring device is—in correspondence with the coin lifting device—arranged at a slight inclination backwards, and hence an incoming coin will rest upon the conveyor belt 14 and may still be transported in the transport direction of the belt. Such a coin transport is carried out at a lower speed than the speed of the conveyor belt 14, since the coin will slip or rotate to a certain extent with respect to the conveyor belt. Once the coin reaches the leftmost, bended portion 28 of the leaf spring, the pressure against the conveyor belt will rapidly grow larger, wherein the slipping of the coin will end and wherein the coin will be accelerated to the speed of the conveyor belt. For this reason the design of the bended portion 28 of the leaf spring as well as the foam-rubber element 17 is of greatest importance, since the pressure force may not be too large (or otherwise the coin will undesirably be retarded), but still the force must be large enough to achieve the coin acceleration described above.

The non-linear spring biasing effect described above, i.e. the unique design of the resilient means, which leads to a coin acceleration up to the speed of the conveyor belt, will solve the problems with previously known, passive coin transferring devices, as described above in section Description of the prior art. For instance, if two coins arrive in close vicinity of each other from the separating knife, which would cause problems in the subsequent sorting process, the leading coin will accelerate away from its pursuer and reach the sorting device with a sufficiently large distance to the next coin. A similar situation is when the coins arrive at the conveyor belt in a triangular orientation with two adjacent coins forming the base and a third coin being positioned on top of these. Even now the situation is remedied thanks to the acceleration feature described above. Other common problems, such as coins placed on top of each other or adjacent coins of substantially different thickness, are also solved by the coin transferring device according to the invention. Furthermore, the device may even handle non-circular coins, e.g. coins with six or eight edges.

Hence, the problems described above are solved by a coin transferring device according to the invention, a device which furthermore may be made short and compact.

The non-linear resilient effect described above may within the scope of the invention obviously be achieved by other means than those described, in dependence on the current application.

Figure 5:
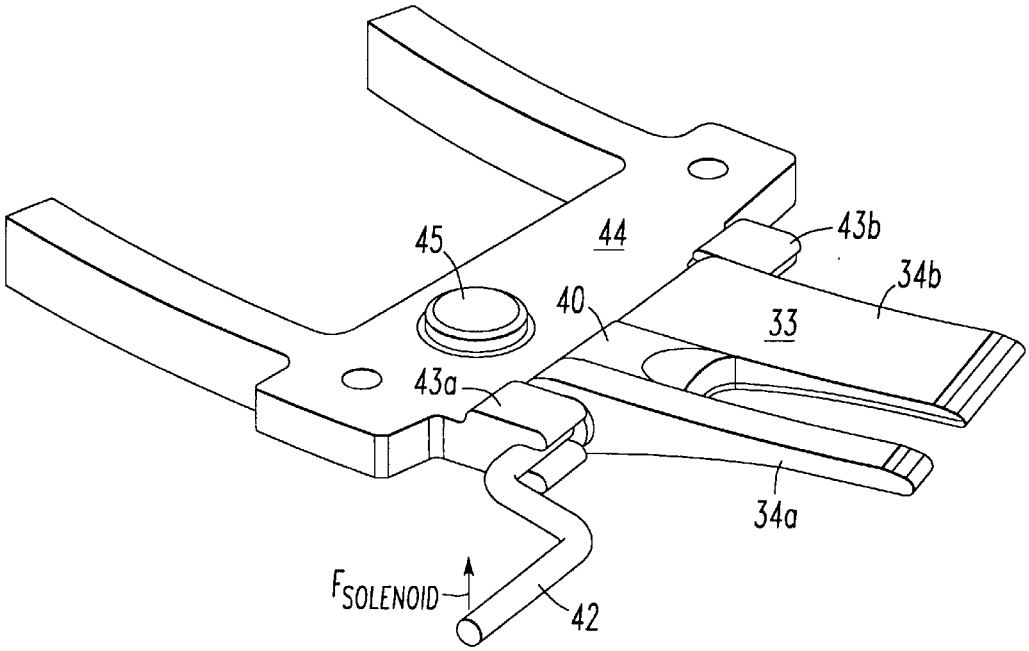
FIG. 5 is a detailed perspective view of an element in the sorting device.
Figure 4:
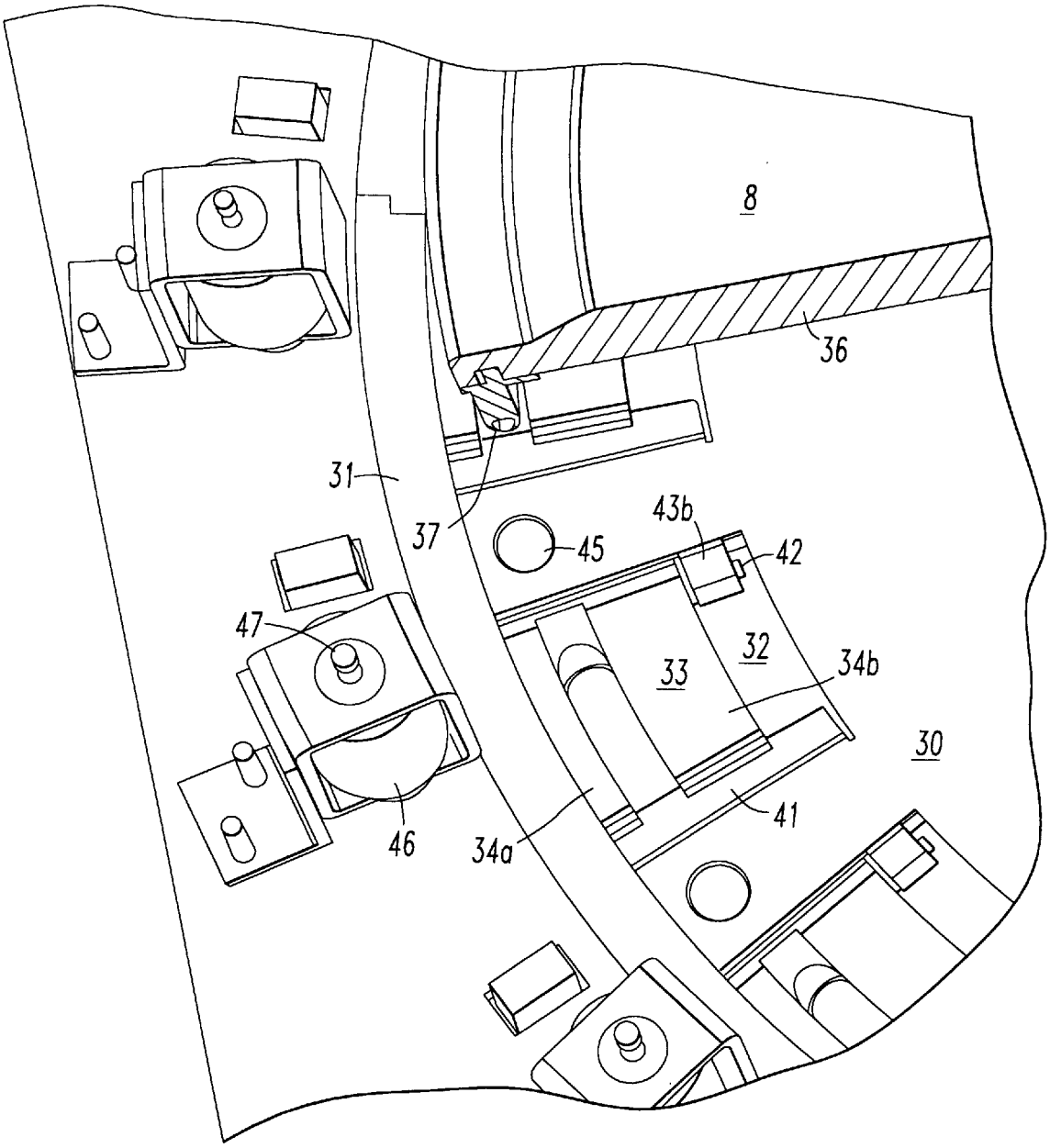
FIG. 4 is a detailed and fractional view of a portion of a sorting device according to the preferred embodiment.

The last step in the coin handling process being carried out by the machine according to the preferred embodiment of the invention is coin sorting by means of the sorting device 8, which is schematically shown in FIG. 1 and in more detail in FIGS. 4 and 5. According to FIG. 1 the sorting device 8 is arranged at the machine front portion 2 in a plane slightly deviating from the plane in which the coin lifting device 3 and the coin transferring device 7 are arranged. This deviation between the planes—the importance of which will be explained below—should be of the order of a few degrees, and according to the preferred embodiment the deviation is about four degrees.

The sorting device comprises a base plate 30, which is firmly mounted to the machine front portion 2 and which comprises a circular border 31 and coin falling openings 32 formed by circularly arranged openings. The coin falling openings essentially have the shape of a trapezium, the parallel sides of which are bended in alignment with the border 31 and the non-parallel sides of which are radially oriented with respect to the border. The outermost one of the parallel sides of each opening is positioned in close vicinity to the inside of the border. There are ten falling openings in the preferred embodiment, the first of which (with respect to the sorting direction) has a special function as a falling opening for rejected coins (i.e. coins not accepted by the machine), as well as other foreign objects.

Each falling opening 32 is provided with a blocking means 33 having the shape of a trap plate with two tongues 34*a*, 34*b*. Each trap plate will normally block its falling opening and thereby prevent a coin passing across the opening from falling down through the same. The details of the falling openings with their blocking means will be described closer below with reference to FIGS. 4 and 5.

In connection to each falling opening 32, on the rear side of the base plate 30, a coin channel is arranged, which connects to a coin receptacle for storing the sorted coins. The design of these may be dealt with by a man skilled in the art, and hence the issue is not brought further here.

The sorting device 8 further comprises a carrier disc 36, which is mounted on the base plate 30 on an axle through the centre of the circle defined by the falling openings 32 or the border 31. The carrier disc 36 is concentric with respect to the border 31 and is rotatable around its axis. The under side of the carrier disc 36, i.e. the side facing towards the base plate 30, is adapted to receive and engage a circular carrier moulding 37. The engagement may for instance be achieved by means of an annular groove, in which the moulding is mounted, or by means of an edge, over which the moulding is forced. The carrier moulding 37 is preferably made from rubber or any similar material, and in the preferred embodiment the moulding is made hollow, but as an alternative it may be massive. The carrier moulding is aligned with the circular falling opening arrangement and will, when rotated, drive incoming coins along a circular path across the falling openings. The design of the carrier moulding—particularly the force exerted on the coins by the moulding—is important, since a weak force, as a consequence of the moulding being too soft, will not be able to carry the coins along a path, while an excessively strong force will generate an excessively large friction between the coins and the base plate. For this reason a hollow carrier moulding has proven suitable. In FIGS. 1 and 4 a preferred embodiment of the carrier disc and the carrier moulding is shown from a partly fractional view.

Furthermore, the sorting device 8 comprises a driving motor mounted on the rear side of the base plate 30. The driving motor, which can be any conventional electric motor, such as a continuous-current motor, drives the axle and, hence, also the carrier disc 36, thereby providing transportation of incoming coins along a circular path across the falling openings. The normal rotational direction of the carrier disc is clockwise, which is indicated by an arrow in FIG. 1. The driving motor is operatively connected to a controller and is therefore rotatable in the backward direction too, i.e. counter-clockwise, for instance with the purpose of clearing coin congestions in correspondence with the description above with respect to the coin transferring device.

The coin transferring device 7 described above is connected according to FIG. 1 to the sorting device 8 at a point in the lower portion of the sorting path. Due to the sorting device according to the above being slightly inclined with respect to the coin transferring device, a coin arriving from the latter may slide in under the rotating carrier moulding 37, which by frictional force will engage the coin and carry it along its circular rotational path across the falling openings 32 in contact with the border 31.

An inclined feedback rail 38 is according to FIG. 1 positioned after the last one of the ordinary falling openings, with respect to the normal rotational direction of the sorting device, i.e. clockwise. One end of the feedback rail 38 is connected to a feedback sorting opening in the base plate 30, whereas a second and free end is positioned above the coin lifting device 3. Through this arrangement any coins, which for some reason have not been duly sorted in the sorting device, may be fed back to the coin lifting device.

Furthermore, the sorting device is provided with a so called coin discriminator or coin detector 39, which according to FIG. 1 is arranged at the beginning of the sorting path immediately after the position, where the coins are supplied to the sorting device from the coin transferring device. The coin detector 39 may not restrict the rotation of the carrier moulding 37, and hence the detector 39 has been given a design as shown in FIG. 1 with a lower and an upper portion, between which the carrier moulding is allowed to run freely. Furthermore, the detector 39 comprises an additional portion, which is arranged behind the base plate 30. Despite these multiple portions the detector 39 is to be regarded as one functional unit, said unit being adapted to measure coin data, when the coins are passing the detector on their circular path. The coin parameters preferably measured are diameter, thickness, conductivity and permeability, but also other parameters may be of interest. Parameters for all different coins, i.e. the various coin values being handled by the machine, are stored in an electronic memory of conventional design. A controller, preferably a microprocessor, is operatively connected to the electronic memory and to the coin detector 39 for processing the coin data obtained, said detector 39 supplying the measured coin data to the microprocessor, which by means of the parameter values stored in the electronic memory will determine the values of the passing coins.

In FIG. 4 there is shown a detailed view of a portion of the sorting device. According to the above a blocking means 33 is provided in each falling opening 32, said blocking means 33 constituting a trap plate with two tongues 34*a*, 34*b*, as is shown in detail in FIG. 5. Between the tongues a spacing is provided, in which a portion of the rotating carrier moulding 37 may run freely. The front edges of the tongues are curved in order for bypassing coins to be able to smoothly slide cross the plate. In addition, the portion 40 between the tongues at the rear end of the trap plate is curved, so that the rotating carrier moulding will not engage said portion and lead to an irregular rotational speed and excessive wear. Furthermore, for optimum carrier function the portion 40 is positioned at a slightly lower level, preferably a few tenths of millimeters lower, than the surrounding tongues 34*a*, 34*b*.

In the down-folded position the front edges of the trap plate tongues are according to the preferred embodiment separated from a tongue 41 on the bottom plate 30 by an air column of approximately 0.1–0.5 mm. In other embodiments the trap plate tongues 34*a*, 34*b* may be in direct contact with the tongue 41. The tongue 41 is slightly bended in a downward direction, and together with the curved portions of the front edges of the trap plate tongues 34*a*, 34*b*, the tongue 41 provides a smooth transition for bypassing coins, which thanks to the smoothly curved shape of the intermediate space have no particular tendency to get stuck or engage at this position.

At its rear end the trap plate is mounted to an axle 42 oriented perpendicularly to the direction of travel for the coins. The axle is mounted in two clamps 43*a*, 43*b* on a body portion 44. The body portion 44 is mounted on the rear side of the base plate 30, and hence only a minor portion thereof is visible through its respective coin falling opening according to FIG. 4. In FIG. 5 the entire body portion is shown, and the mounting of the trap plate axle described above appears from the figure. Additionally, a tracking sensor 45 is arranged on each body portion 44. The tracking sensor is covered with a protective plastic layer and is laid open at a certain recess through an opening in the base plate 30. The purpose of the tracking sensor is to detect the presence of a bypassing coin and to report this detected presence to a controller operatively connected to the tracking sensor. According to the preferred embodiment the detection is carried out by inductive means, but it may obviously be achieved by other means well-known to a man skilled in the art.

On the machine front 2, outside the border 31, an actuator 46 is arranged for each coin falling opening. The actuator, preferably a solenoid, is operatively connected to a controller and is arranged to lift its respective trap plate at a given moment from its original and blocking position, wherein a bypassing coin will not continue along its path around the sorting device but slide in beneath the trap plate on the tongue 41 and fall down through the falling opening now uncovered, and thus the coin is separated. For this reason a movable part 47 in the actuator 46—preferably the movable core in the solenoid—is connected to the trap plate axle 42, which according to FIG. 5 is bended in two positions at a substantially right angle at one of its ends. The solenoid has two operating modes; a powerless mode, wherein the movable core 47 is at an initial position, where no force is applied to the axle 42, and a current carrying mode, wherein the core is displaced upwards with respect to the plane of the front 2 and applies an upwardly directed force $F_{solenoid}$ to the axle, said axle being slightly rotated counter-clockwise and lifting the trap plate 33 to an extent, which is large enough for allowing a coin to pass beneath the plate to be sorted through the falling opening.

In addition a pulse counter is arranged at the centre of the carrier disc 36 so as to supply the angular position of the carrier axle at given instances to a controller operatively connected to the pulse counter.

According to the above the tracking sensors 45, the coin detector 39 and the pulse counter are all operatively connected to controllers. In the preferred embodiment these controllers are realised as one single microprocessor, said microprocessor being operatively connected also to the solenoids 46. Other embodiments may comprise multiple controllers, which cooperate in a way well-known to a man skilled in the art so as to achieve the functions described below.

When a coin has been supplied to the sorting device and been brought into its circular path across the falling openings by means of the carrier disc, the coin will pass the coin detector 39, wherein coin data will be measured and supplied to the microprocessor, as described above. The microprocessor will determine the type of the coin, i.e. the value, by means of measurement values stored in the electronic memory, and it will calculate a so called pulse delay time for the coin. This pulse delay time corresponds to the number of pulses that the pulse counter of the carrier disc will provide, until the coin in question has been transported from the coin detector to the respective coin falling opening. Hence, the microprocessor uses information about the angular position of the carrier disc, said angular position being supplied by the pulse counter as a number of pulses elapsed since a given time (usually starting from the point of time, when the coin passes the coin detector).

The transportation of the coin along the path is not ideal but is carried out under influence from interfering factors, such as slipping against the carrier moulding, and hence the microprocessor will in addition use information received from the tracking sensors, which according to the above will notify the microprocessor, when a coin is passing. When the pulse delay time has elapsed, the microprocessor will consequently check that a given tracking sensor has indeed detected the passing coin, while the subsequent tracking sensor has not detected the particular coin, thereby indicating that the coin is at a position immediately before the appropriate falling opening. If this condition has been fulfilled, the microprocessor activates the appropriate solenoid, which receives current and lifts its associated trap plate by means of the solenoid core protruding from the solenoid, thereby turning its trap plate axle. In that way the coin is separated and will fall down through the appropriate coin falling opening via the coin channel to the correct coin receptacle, wherein the coin will be stored.

If for some reason the coin did not fall through the opening, e.g. due to a slight delay in the opening of the trap plate, this will be indicated when the subsequent tracking sensor detects the presence of the coin. In such cases the coin will continue along its circular path across all remaining coin falling openings and will then be fed back to the coin lifting device through the feedback rail 38 described above, thereby providing the coin with a new opportunity to be separated and sorted.

In such cases where there is no correspondence between coin data obtained by the coin detector and the data stored in the electronic memory, the coin is regarded to be invalid, wherein the microprocessor will send a control signal to the first one of the solenoids with respect to the sorting direction, and this solenoid will open its associated trap plate, thereby separating the invalid coin to be collected in e.g. a receptacle for rejected coins arranged on the front of the machine.

The values for all bypassing and valid coins are registered by the microprocessor, this registered information being used at a later stage for reporting count data statistics, such as total amount counted and total number of coins of each type.

The machine is additionally provided with input and output means for user communication. For instance, a display and a keypad are operatively connected to the microprocessor, the display being suitable for presentation of coin counting information and the keypad being suitable for controlling the machine operation. The display and the keypad, as well as the method in which they cooperate with the microprocessor, are regarded as obvious or well-known to a man skilled in the technical art of computer engineering, and hence these elements are not described in more detail.

According to the preferred embodiment described above the first part of the machine is constituted by a coin lifting device with a disc, which is rotatable in a substantially vertical direction. Within the scope of invention, as defined in the appended independent patent claims, it is possible to use other types of coin lift devices, for instance such a device which is shown in U.S. Pat. No. 5,163,868, as described above. Another possible type of coin lifting device is such a device, which is already being used in our existing SC-4000 model, which has been commercially available for a while now and which is schematically illustrated in FIG. 6.

Figure 6:
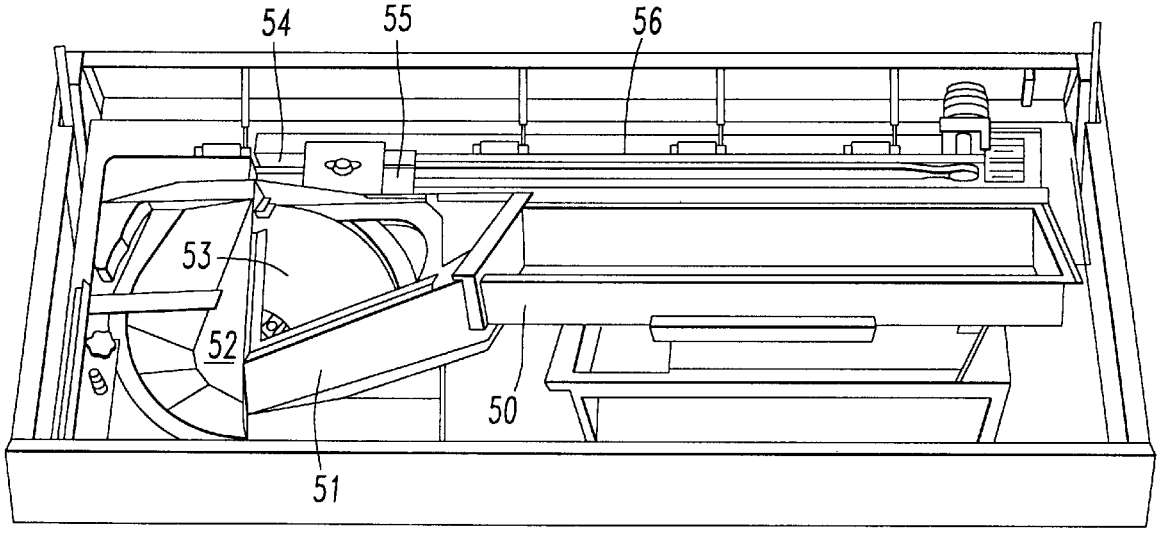
FIG. 6 PRIOR ART
FIG. 6 is a schematic perspective view of a commercially available machine, in which the features according to the present invention may be applied so as to constitute, in combination, an alternative embodiment of the invention.

The machine according to FIG. 6 is provided with a vibrating tray 50, which is adapted to receive an unsorted mass of coins. The tray 50 is vibrated, and the coins are shaken towards an opening at an end of the tray. The opening in the tray is connected to a ramp 51, along which the coins from the tray will slide down to be collected in a coin lifting bowl 52. The bowl 52 comprises a rotatable disc 53, which is arranged in an essentially horizontal orientation, however at a slight upward inclination towards the subsequent parts described below, i.e. upwards with respect to the drawing. The disc 53 is rotated in the clockwise direction and is in correspondence with the coin lifting device previously described arranged to forward the coins in the mass of coins at a proper rate to the sorting step. The coins in the coin lifting bowl 52 are excerted to a centrifugal force due to the rotation, and hence the coins are driven in the outward direction towards the circumference of the disc 53, which is arranged to frictionally engage the coins in their path along the circumference. The bottom layer of coins on the disc 53 are thus maintained and may be forwarded to a coin transferring device 54. This device is constituted by a rotatable conveyor belt, the purpose of which is to transfer forwarded coins to the sorting device.

In correspondence with the description above for the preferred embodiment of the invention the passage through the coin transferring device 54 is necessary for allowing the coins to "sort themselves out" prior to the arrival to the actual sorting device. By providing the coin transferring device 54 with a resilient means—such as a leaf spring according to the preceding figures—the same advantages are achieved as with the embodiment described above, i.e. a passing coin will be pressed against the conveyor belt and will consequently be accelerated to a higher speed, thereby remedying such situations, where coins are positioned on top of each other or immediately after one another.

Furthermore, according to FIG. 6 the machine is provided with a linear sorting arrangement 56 rather than the circular sorting device previously described. Here the sorting device comprises a second conveyor belt, which is rotated from the left to the right in the figure and will hence transport the coins received from the coin transferring device 54 in the same direction. The coins will pass a so called coin discriminator or sensor 55, by means of which suitable parameters (such as diameter, thickness or conductivity) are measured for the passing coin and in response to which the coin value or the like is determined. A plurality of rejection means—one for each coin value—are arranged along the conveyor belt and are responsive to a control signal, which is generated in accordance with the coin value determined. When such a control signal is received, the rejection means in question is activated, the coin thereby being removed by mechanic means from the conveyor belt to be collected in a receptacle for each respective type of coins.

Finally it is appreciated that the principle of having a resilient means acting in a transportation channel may be applied in yet another type of machine, i.e. such a machine where the coin lifting device is constituted by a bowl, which is rotatable around its centre axis, said bowl on its inner side being provided with a rail, which extends helically from the bottom of the bowl to its upper portion. An unsorted mass of coins is deposited at the bottom of the bowl, and thanks to the rotation of the bowl the coins are forwarded along the helical rail so as to reach the upper edge of the bowl. Preferably, the rail is thin enough to only allow one single coin at a time at a given position, but still it may not be entirely possible to avoid more than one coin from arriving "close together" at the upper edge of the bowl. Once the coins have reached the upper edge, they will continue to rotate around the edge due to the rotation of the bowl.

Figure 7:
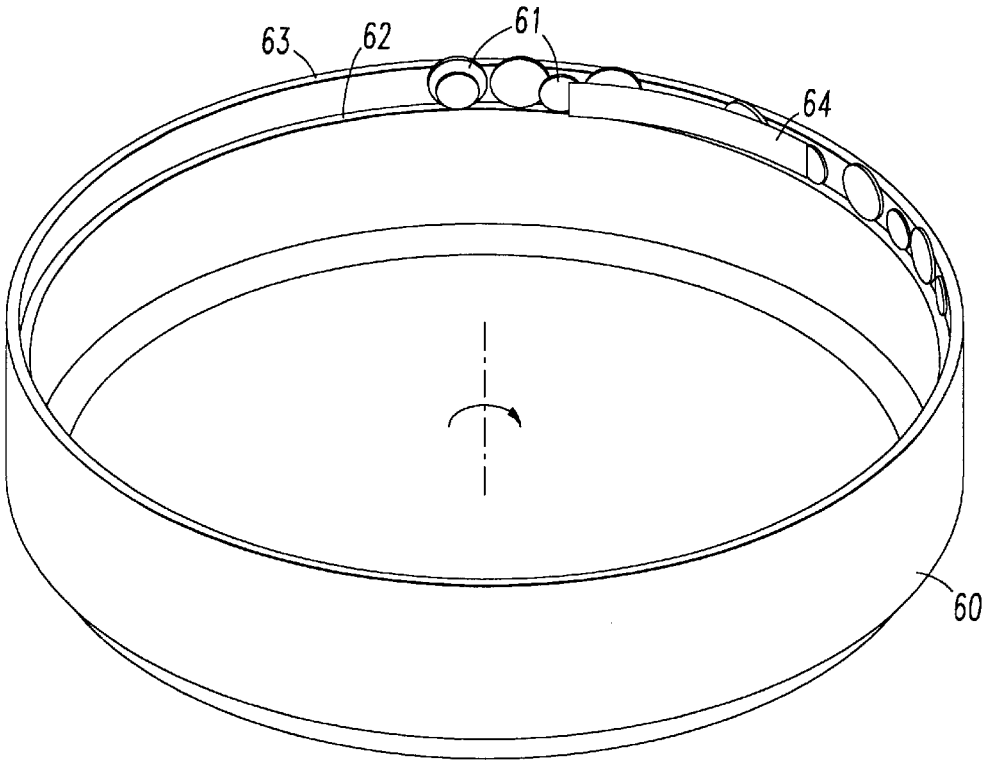
FIG. 7 is a simplified perspective view, which illustrates yet another embodiment of the invention.

This situation is schematically shown in FIG. 7, where the bowl rotated in the clockwise direction is labelled 60. A number of coins 61 have been forwarded at a certain disorder through the helical rail not disclosed in the figure to the upper edge 62 of the bowl 60. The coins are in contact with a border 63, which has been illustrated as being excessively high and which in reality is only a few mm high. The border 63 is covered with e.g. a rubber material, and through the rotation of the bowl 60 the coins are driven forward on the inner side of the border 63 while slipping to a certain extent on the same. A plurality of rejection means not illustrated in the figure are arranged along a portion of the border 63 so as to expose a passing coin to a mechanical impulse in the radial direction of the border, i.e. at a substantially right angle towards the coin, when a control signal is received in correspondence with the above. Additionally, a coin discriminator not specifically shown is arranged at a suitable position along the border 63 so as to determine the coin value and to activate the proper rejections means in response thereto.

A resilient means 64 is arranged along the inner side of the border 63. The resilient means is, just as the rejection means, mounted on an inner element of the machine not illustrated in the figure, said inner element being aligned with the circular shape of the border 63 just inside the same. A narrow space is formed between the fixed inner portion and the movable border 63, and thus a transportation channel is formed for the coins. The resilient means 64 is arranged to press a passing coin against the border 63, wherein the frictional engagement of the rotating border with the coin is enhanced, thereby leading to a decreased degree of slipping and hence an increased transportation speed. In correspondence with what has been previously described, the coin will consequently accelerate away from any adjacent coins, at the same time remedying difficult situations with double coins or coins oriented in a triangular arrangement, etc. Therefore, it is assured that the order among the coins with respect to each other is sufficiently good, before they reach the actual sorting step.

The preferred and the alternative embodiments of the machine according to the invention described above are only embodiment examples. Other embodiments may deviate from the ones described above within the scope of the invention, as defined in the appended patent claims. Furthermore, the term "coin" is to be given a general meaning, so that also objects having a resemblance to coins—such as tokens or markers—are embraced.

I claim:

1. A machine for coin counting and sorting, comprising a coin lifting device (3) for receiving and forwarding an unsorted mass of coins, a sorting device (8) for sorting the coins being provided thereto, and a coin transferring device (7) for transferring the coins from the coin lifting device to the sorting device while establishing an order among the coins suitable for the sorting and counting process, characterized in that the coin transferring device comprises:

a first and a second element (14, 18), between which a transportation channel for the coins is formed, said first element being movable with respect to the second element so as to effect the transferring of the coins, and resilient means (16, 17) arranged within the transportation channel for pressing the coins against the movable first element (14) with a locally increased coin transferring speed as a result.

2. A machine according to claim 1, wherein a conveyor belt (14) connected to a driving means (15), said conveyor belt constituting said first element of the coin transferring device, a supporting means (18) for the coins, said supporting means constituting the second element of the coin transferring device, and a leaf spring (16) being mounted at its first end (27) to the supporting means (18) and being bended at its second, free end (28), said leaf spring being arranged to press coins against the conveyor belt (14) with a force, which is stronger at the second end of the leaf spring than at the first end thereof.

3. A machine according to claim 2, wherein an element (17) of foam-rubber or the like arranged between the supporting means (18) and the second, free end (28) of the leaf spring (16), said element enhancing the pressing force of the leaf spring on coins against the conveyor belt (14).

4. A machine according to claim 2, wherein the supporting means (18) comprises an upper, vertical portion (21) and a lower, horizontal portion (22), the upper, vertical portion being provided with means **(24*a*, 24*b*, 25) for mounting the leaf spring (16) at one of its ends (27) and said lower, horizontal portion at least partly being provided with a layer (29)** of an anti-bounce material.

5. A machine according to claim 1, wherein the sorting device (8) comprises a base plate (30) with coin falling openings (32) and a carrier (36) being movably arranged along the upper side of the base plate for driving the coins along a circular path across the coin falling openings, characterized by blocking means (33) arranged at least at some of the coin falling openings for preventing coins from falling down through the opening, an actuator means (46) for each blocking means, and a coin sensing means (39) for detecting the value of passing coins, said coin sensing means being operatively connected to the actuator means for selectively activating these in response to the coin value detected, and each actuator means being operatively connected to a respective blocking means for temporarily suspending the blocking of the blocking means for a respective coin falling opening, when said actuator means is activated by the coin sensing means.

6. A machine according to claim 5, wherein each blocking means (33) is constituted by a trap plate mounted on the rear side of the base plate (30), said trap plate being rotatably mounted on an axle (42) connected to the actuator means (46) for lifting the trap plate and suspending the blocking exercised by the trap plate on the coin falling opening (32).

7. A machine according to claim 6, wherein each actuator means (46) is constituted by a solenoid and in that said rotatable axle (42) is connected to a movable core (47) of the solenoid.

8. A machine according to any of claim 5, wherein the carrier is constituted by a rotatable circular disc (36) with a moulding (37) of rubber or the like, said moulding being mounted on the side of the disc facing towards the base plate (30) in close vicinity to the circumference of the disc so as to drive the coins along said circular path.

9. A machine according to claim 8, characterized in that the moulding (37) is provided with a cavity.

10. A machine according to claim 8, wherein said trap plate (33 comprises two tongues **(34*a*, 34*b*), said tongues extending in the longitudinal direction of said circular path and the free ends of which being curved, wherein the space between the tongues is slightly larger than the width of the moulding (37)** and wherein the moulding is arranged to run freely within said space.

11. A machine according to claim 5, wherein a sensor (45) arranged at each coin falling opening (32) for detecting a passing coin, a position sensor for said carrier (36), and a controller, which is operatively connected to all of the sensors (45), to the position sensor, to said coin sensing means (39) and to said actuator means (46), said controller being arranged to control the actuator means corresponding to the coin value detected in response to input data from said sensors, said position sensor and said coin sensing means, so as to temporarily suspend the blocking of the corresponding blocking means (33) exercised on its associated coin falling opening.

12. A machine according to claim 5, wherein a feed-back rail (38), which is connected at a first end to the sorting device (8) and at a second end to the coin lifting device (3) for returning coins not sorted by the former back to the latter.

* * * * *